US006460254B1

(12) United States Patent
Mori et al.

(10) Patent No.: US 6,460,254 B1
(45) Date of Patent: Oct. 8, 2002

(54) CUTTER

(75) Inventors: Makoto Mori; Xiao Dong Wu, both of Katsushika-ku (JP)

(73) Assignee: Carl Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/691,111

(22) Filed: Oct. 19, 2000

(30) Foreign Application Priority Data

Oct. 29, 1999 (JP) ..... 11-309050

(51) Int. Cl.[7] ..... B26B 1/00

(52) U.S. Cl. ..... 30/286; 30/319; 30/320; 30/321

(58) Field of Search ..... 30/307, 319, 320, 30/321, 286, 292, 293; 83/398, 397

(56) References Cited

U.S. PATENT DOCUMENTS

| | | | | | |
|---|---|---|---|---|---|
| 3,711,945 | A | | 1/1973 | Cronheim | |
| 4,100,677 | A | * | 7/1978 | Jeff | 30/321 |
| RE32,501 | E | * | 9/1987 | Okada | 30/292 |
| 5,144,749 | A | | 9/1992 | Chen | |
| 5,355,588 | A | | 10/1994 | Brandenburg, Jr. et al. | |
| 5,400,512 | A | * | 3/1995 | Brush | 30/321 |
| 5,463,942 | A | * | 11/1995 | Hupf et al. | 99/537 |
| 5,493,781 | A | * | 2/1996 | Saito | 30/162 |
| 5,765,289 | A | * | 6/1998 | Schulz et al. | 30/319 |
| 5,787,779 | A | * | 8/1998 | Garuglieri | 83/397 |
| 6,094,824 | A | * | 8/2000 | Takeshita | 30/276 |
| 6,282,794 | B1 | * | 9/2001 | Cho et al. | 30/151 |

FOREIGN PATENT DOCUMENTS

DE 90 03 291 U 7/1990

* cited by examiner

*Primary Examiner*—Kenneth E. Peterson
*Assistant Examiner*—Omar Flores-Sánchez
(74) *Attorney, Agent, or Firm*—Oliff & Berridge, PLC

(57) ABSTRACT

Around a push button formed on an arm 3, teeth are disposed at a regular angle, and around the push button inserting hole in a handle 4 grooves are disposed corresponding to the teeth, thereby, by biasing the arm 3 with a compressed coil spring to engage the teeth with the grooves. Whereby, by pushing the push button to cause the arm to stroke, the engagement of the teeth and the groove is released to cause the arm 3 to turn and by freeing the push button the teeth and the grooves are engaged, thereby the arm 3 is positioned and held at a desired position.

9 Claims, 11 Drawing Sheets

CUTTER

BACKGROUND OF THE INVENTION

1. Field of the Invention

The present invention relates to a cutter installed with a rotary blade, in particular a cutter with a safety device.

2. Conventional Art

A cutter comprises, as shown in FIG. 15, an arm 51 installed rotatably with a circular cutter (hereinafter referred to as "rotary blade") and a handle 52, and is structured as it cuts an edge of things to be cut in a desired shape by running a rotary blade 53 on a cutting surface 54 of the thing to be cut in an arrow A direction of FIG. 15 while pushing the rotary blade 53. When cutting things to be cut with a cutter 55, it is easy to move the rotary blade 53 straight by keeping an angle of the cutter 55, that is, an angle formed between the arm 51 and the cutting surface 54 (θ of FIG. 15) as 45 degrees, and it has been known that the cutting becomes easier as smaller the angle (θ of FIG. 15) formed between the arm 51 and the cutting surface 54 as possible, that is, by laying the arm 51 the rotary blade 53 turns at a smaller turning radius for cutting.

However, in a conventional cutter 55, since the arm 51 is provided fixedly on the handle 52 or integrally with it, and for instance, where a thing to be cut is cut straight, in order to move the rotary blade 53 straight, as shown in FIG. 15, cutting work is carried out by holding the arm 51 at an angle 45 degrees to the cutting surface 54, a worker in a sitting posture in particular have to bend his wrist or raise his elbow during a long time working for cutting, which was a burden for him. Further, the cutter 55 is provided generally with a guard 56 as a safety device for a cutter of the rotary blade 53, which is structured in such a manner as the guard 56 is provided on one side of the rotary blade 53 to come out or to be retracted by sliding the guard 56 itself, or the rotary blade 53 itself moves to slide the cutter of the rotary blade 53 for protection, by which for a left-handed person it is difficult to watch a cutting portion because his eyesight is shut by the guard 56 to make the cutting work difficult.

The present invention has been made in the light of the above problem, and an object thereof is to provide a cutter in which an arm can be positioned and held at any desired angle to a handle, thereby regardless of a worker left- or right-handed a desired cutting can be carried out easily and safely.

In order to attain the above object, according to a first aspect of the present invention, in a cutter installed with a rotary blade, the cutter comprises an arm one end of which is pivoted on a handle and on other end of which the rotary blade is mounted and a guard provided movably forward and backward, wherein the arm can be positioned and held at any desired angle to the handle.

By constituting as such, since the angle of the arm can be set and held to the handle, it is easily carried out to cut the things to be cut, and since a guard for protecting a rotary blade is provided, it is easy to operate the cutter safely.

Further, according to a second aspect of the present invention, a rotary movement of the arm a guard of which is retracted is limited.

By this, the rotary movement of the arm where a tip end of a cutter of the rotary blade is projected is limited to enable a positioning operation of the arm can be carried out safely.

EMBODIMENT

Figure 1:
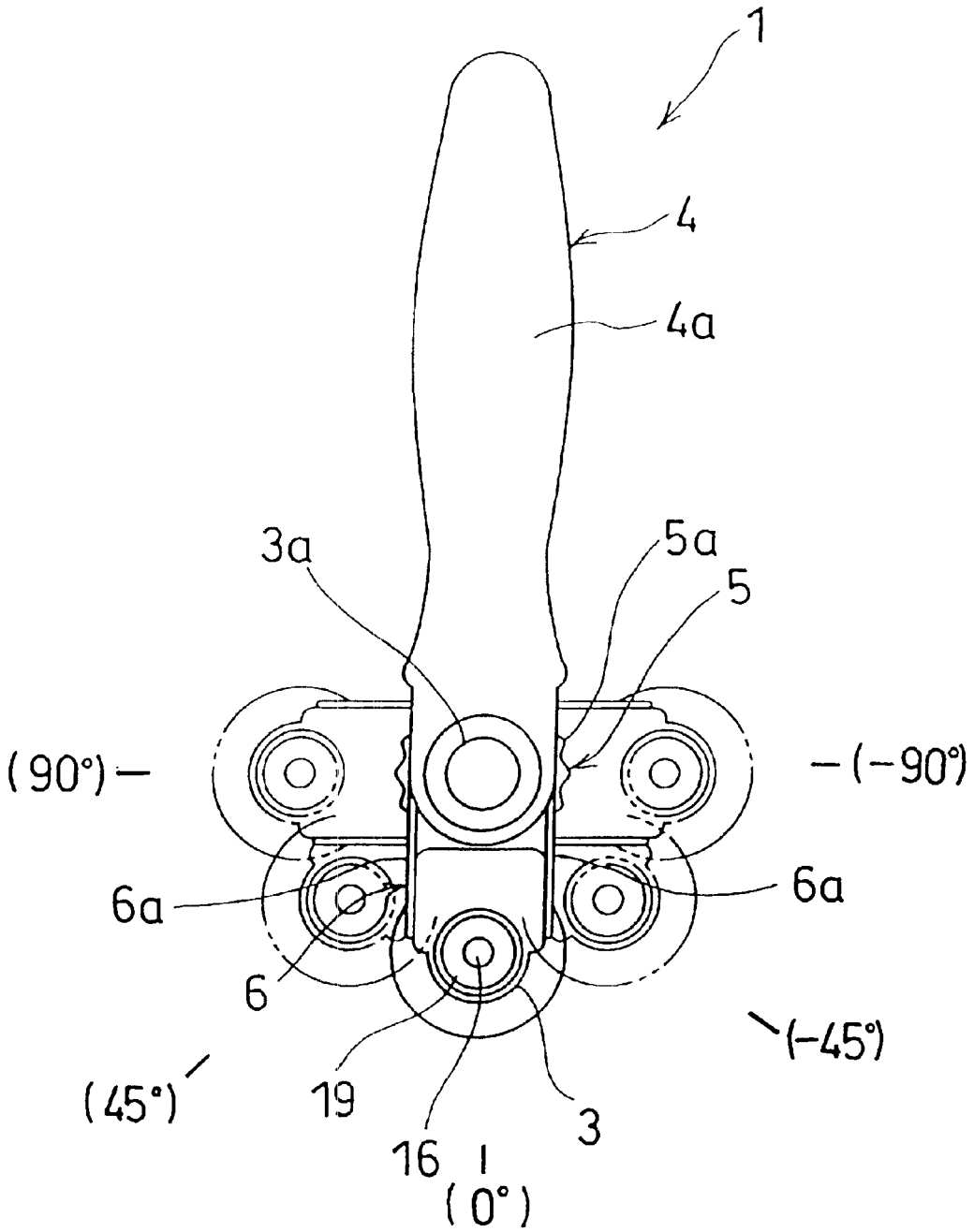
FIG 1 is for explaining an embodiment of the cutter of the present invention.

One embodiment of a cutter of the present invention will be explained referring to FIGS. 1~14. First, a cutter of this embodiment is outlined. The cutter 1 of this embodiment comprises, as shown in FIG. 1, an arm 3 pivoting a rotary blade 2 rotatably and a handle 4 holding the arm 3 and by pushing a push button 3*a*, the arm 3 becomes possible to turn around a supporting shaft for the arm 3 and be held (positioned) at every 45 degrees. Further, the cutter 1 is provided with a guard 6 which is moved forward and retracted backward by rotating a dial formed on a guard driving member 5, explained later, and in a state where the guard 6 is retracted, that is, the cutter of the rotary blade 2 is not guarded, the push button 3*a* is locked and the turning of the arm 3 is limited.

Figure 2:
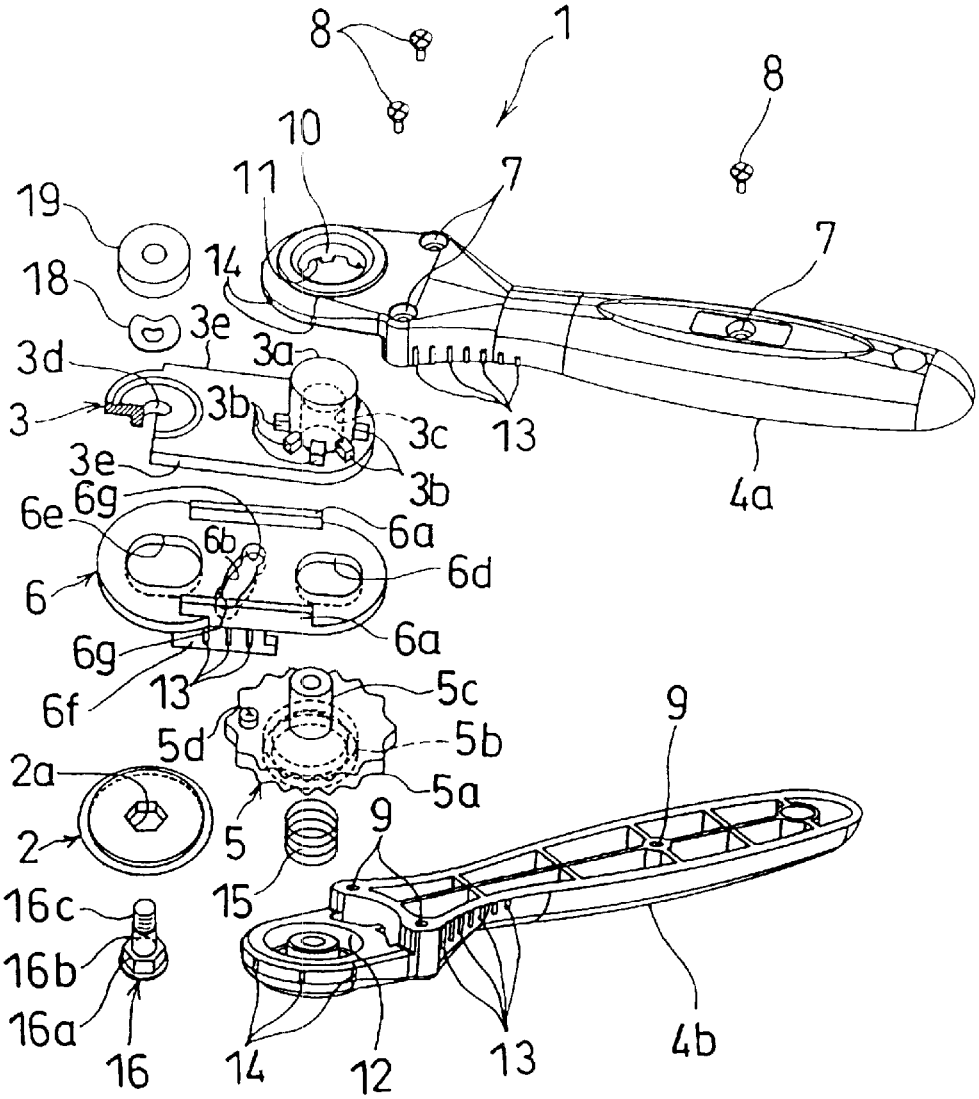
FIG 2 is an exploded perspective view of an embodiment of the cutter of the present invention.
Figure 3:
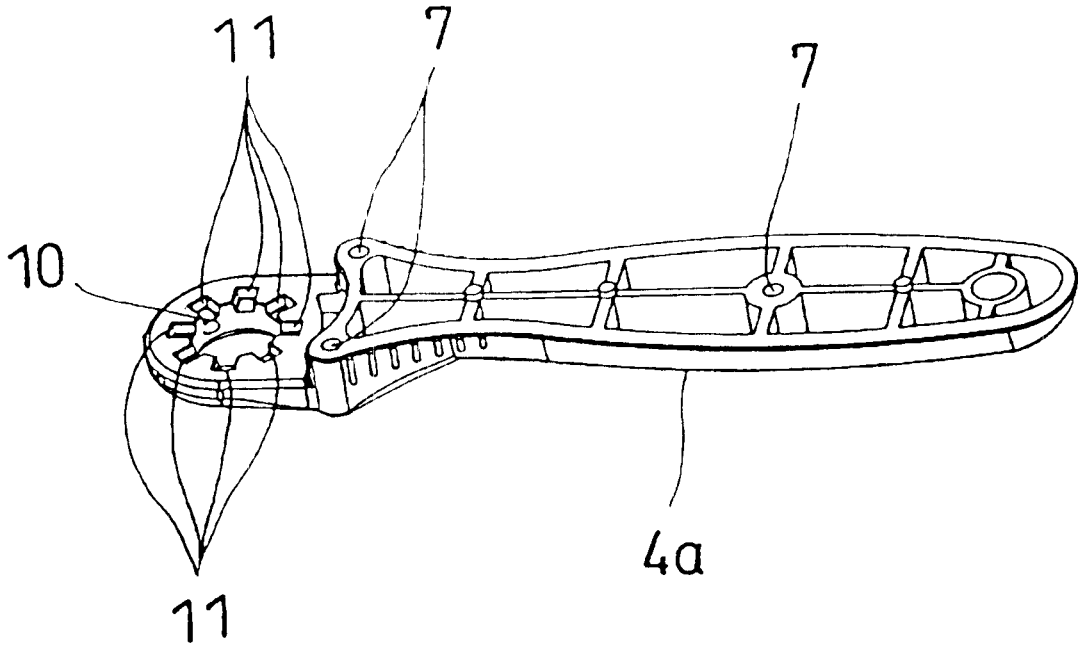
FIG 3 is for explaining a groove formed on a front handle of the cutter of the embodiment of the present invention.

Next, details of each constitution of the cutter 1 are explained. The handle 4 is constituted in such a manner as it clamps, as shown in FIG. 2, the arm 3 with the front handle 4*a* and the back handle 4*b* and the front handle 4*a* and the back handle 4*b* are connected by inserting the screw 8 into a screw hole 7 formed in the front handle 4*a* and being engaged with a screw hole 9 formed in the back handle 4*b* and tightened. And, in the handle 4*a* of the front handle through hole 10 for the push button 3*a* is formed, and on a back side of the front handle 4*a,* as shown in FIG. 3, around the push button through hole 10 grooves 11 later mentioned are formed so as to be in cope with later mentioned teeth 3*b* of the arm 3. Further, on a back side of the front handle 4*b,* as shown in FIG. 2, an annular groove 12 to make a ring 5*b* formed on a later mentioned guard driving member 5 and house a compressed spring 15. A sign 13 shown in FIG. 2 is small convex projections formed on the surface of the handle 4 to prevent the handle 4 from sliding and 14 is an angle scale which becomes a positioning. reference when positioning the arm 3.

Next, the arm 3 is explained. The arm 3 is configured in such a manner it is molded integrally with a push button 3*a* formed column-like and teeth 3*b* disposed annularly around the push button 3*a,* the teeth 3*b* are disposed around the push button at a regular 45 degrees. And, arm 3 is arranged in such a manner as it is positioned at every 45 degrees to the handle 4 by engaging each of the teeth 3*b* with the groove 11 which is provided so as to cope with teeth 3*b* on the back side of the front handle 4. Further, the arm 3 is, as shown in FIG. 3, biased toward the front handle 4*a* by compressed coil spring 15 housed between the back handle 4*b* and the guard driving member 5, and by pushing the push button 3*a* formed on the arm 3 and compressing the compressed coil spring 15, the teeth 3*b* is removed from the groove 11 to enable the arm 3 to turn around the arm supporting shaft, and by positioning the arm 3 at a given position, releasing the push button 3*a* the teeth 3*b* is caused to engage with the groove 11 and is positioned to the handle 4 at every 45 degrees and held. And, as shown in FIG. 2, on the back side of the push button 3*a,* a shaft hole 3*c* to fit a supporting shaft 5*c* formed on the guard driving member 5 is formed, the arm 3 is constituted in such a manner as it is pivoted rotatably around the supporting shaft 5*c* by fitting a ring 5*b* of the guard driving member 5 rotatably in the annular groove 12 of the back handle 4*b* and fitting the shaft hole 3*c* in the supporting shaft 5*c* of the guard driving member 5. Further, as shown in FIG. 2, a shaft hole 3*d* for supporting a shaft 16 to support axially a rotary blade 2 is rotatably formed.

Next, the guard 6 and the guard driving member 5 will be explained. The guard 6, as shown in FIG. 2, on an upper surface of an elliptical plate, a pair of opposing guide portions 6*a* are formed so as to be guided along side face 3*e* of the arm 3 are formed and the elliptical plate is provided with an engaging hole 6*b* to engage with an engaging portion 5*d* formed projected-like on a dial 5*a* of the guard driving member 5, and by turning the dial 5*a* of the guard driving member 5 a force F (see FIG. 4) is acted on a contact portion between the engaging portion 5*d* and a slant surface 6*c* of the engaging hole 6*b,* which causes the guide portion 6*a* to move and slide along the side surface 3*e* of the arm 3. Further, the guard 6 is provided with, as shown in FIG. 2, a long hole 6*d* for being penetrated with the supporting shaft 5*c* formed on the guard driving member 5 and a long hole 6*e* for penetrating the shaft 16 supporting axially the rotary blade 2, and further below a bottom surface of the guard 6 a block 6*f* for protecting a side portion of the handle 4 of the cutter of the rotary blade 2 is formed. For reference, as shown in FIGS. 2 and 4, in the engaging hole 6*b* of the guard 6 on both ends thereof hooking portions 6*g* to hook the engaging portion 5*d* are formed.

Figure 6:
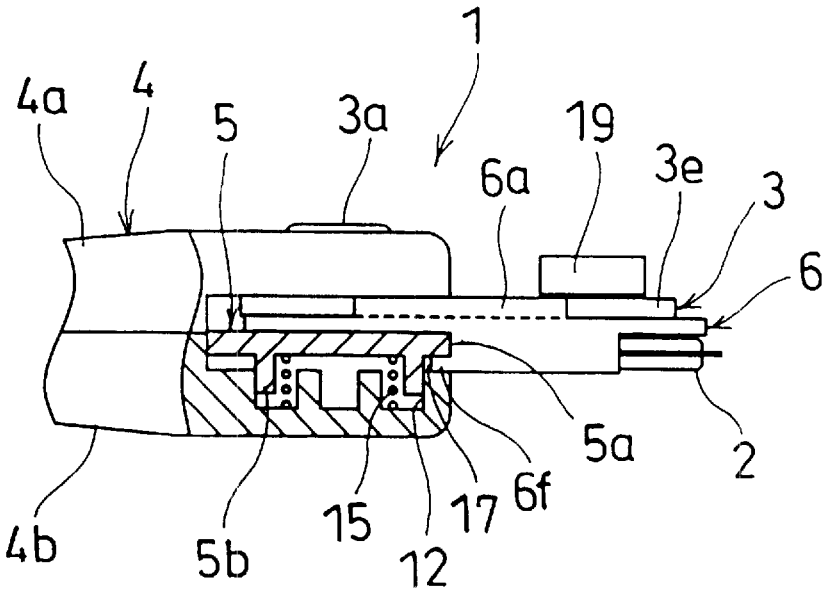
FIG. 6 is a side view showing, partially in section, a state where the guard is retracted in the embodiment of the cutter of the present invention.
Figure 7:
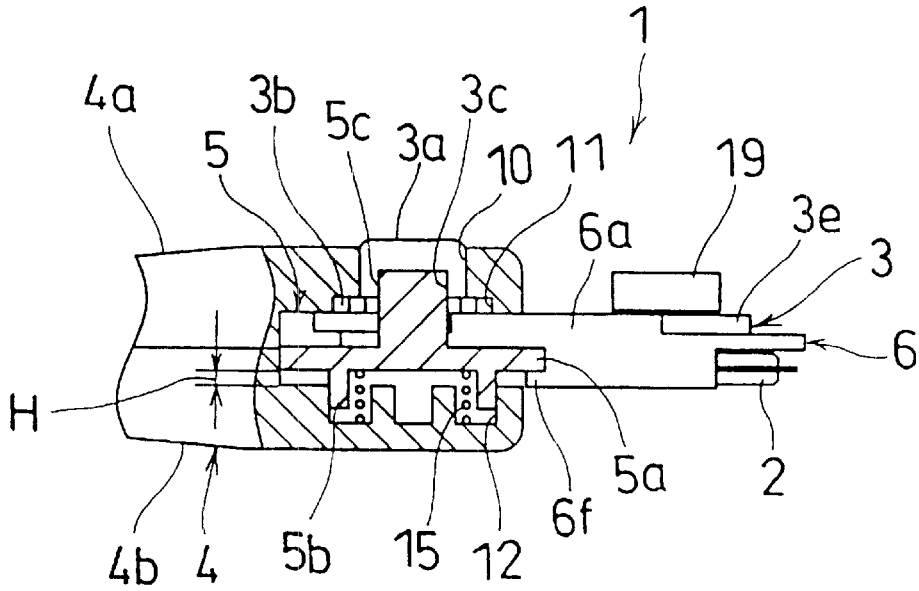
FIG. 7 is a side view showing, partially in section, a prior state where a push button is not pushed in the embodiment of the cutter of the present invention.
Figure 8:
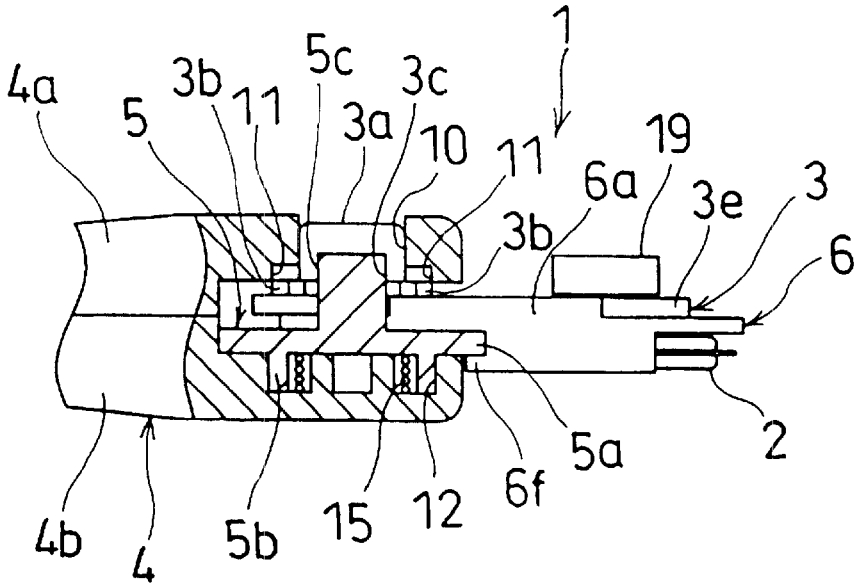
FIG. 8 is a side view showing, partially in section, a state where a push button is pushed in the embodiment of the cutter of the present invention.
Figure 9:
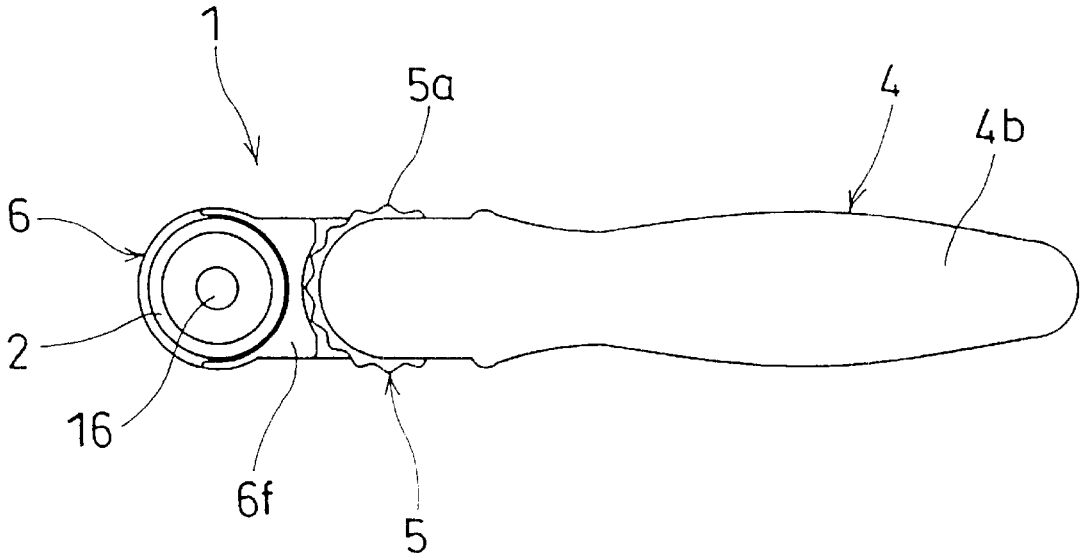
FIG 9 shows a front view of the cutter of the embodiment of the present invention, in particular, for showing a state where a guard comes forward with an angle 0 degree of the arm.
Figure 10:
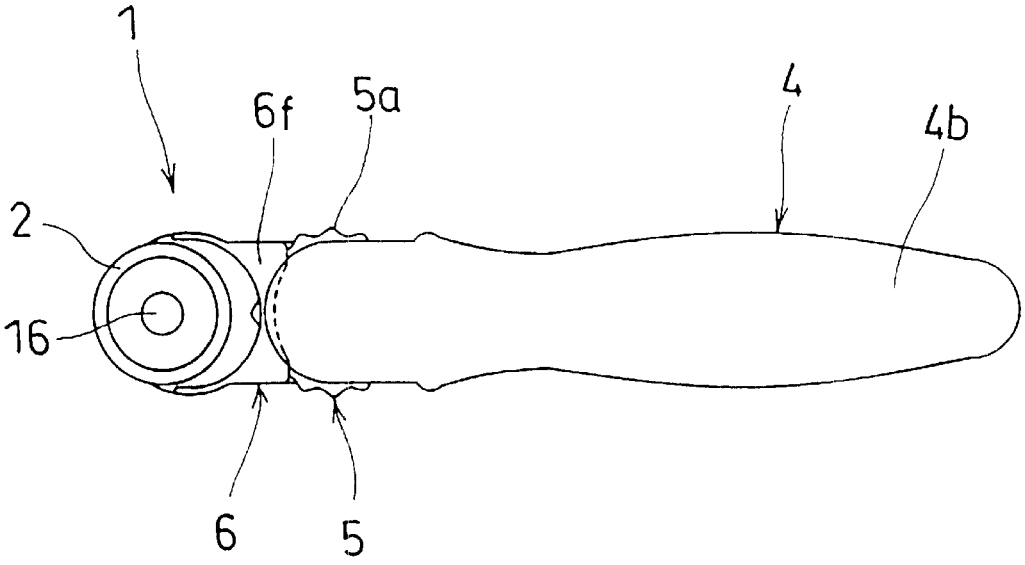
FIG 10 shows a front view of the cutter of the embodiment of the present invention, in particular, for showing a state where a guard comes backward with an angle 0 degree of the arm.

Further, in the cutter 1, as shown in FIG. 2, the compressed coil spring 15 is installed inside between an inner side of the annular groove 12 of the back handle 4*b* and the ring 5*b* and fitted by the guard driving member 5 (see FIGS. 5 and 6), and the supporting shaft 5*c* of the guard driving member 5 is penetrated in the long hole 6*d* formed on the guard 6 and the engaging portion 5*d* of the guard driving member 5 is engaged with the engaging hole 6*b* formed on the guard 6, and arm 3 is disposed in such a manner as the shaft hole 3*c* of the arm 3 is inserted in the supporting shaft 5*c* of the guard driving member 5 projected from the long hole 6*d* of the guard 6 and a pair of guide portions 6*a* formed on the guard 6 are guided along the side surface 3*e* of the arm 3. And, the cutter 1 is structured by inserting the push button inserting hole 10 of the front handle 4*a* in the push button 3*a* formed on the arm 3, engaging teeth 3*b* disposed around the push button 3*a* of the arm 3 with the groove 11 of the front handle 4*a* and connecting the front handle 4*a* and the back handle 4*b*. Further, the cutter 1 has, in a state where the push button 3*a* is not pushed, as shown in FIG. 7, a given spacing (H in FIG. 7) in the compressed direction of the compressed coil spring 15 between the guard driving member 5 and the back handle 4*b,* and by pushing the push button 3*a,* as shown in FIG. 8, the arm 3, the guard 6 and the guard driving member 5 are stroked and the teeth 3*b* of the arm is disengaged from the groove 11 of the front handle 4*a* to cause the arm 3 is made to be turned to the handle 4. Further, the arm 3 is formed possible to be positioned, as shown in FIG. 1, as a standard of 0 degree (see FIGS. 9 and 10) where the arm 3 and handle 4 are positioned linearly, from +90 degrees (see FIG. 12) to −90 degrees (see FIG. 14) at every 45 degrees. Further, the cutter 1 is provided with an interlock to restrict the rotary movement of the arm when the guard 6 is retracted, as shown in FIG. 6, and constituted in such a manner as a block 6*f* formed on the guard 6 is interposed in a gap 17 between a bottom surface of the dial 5*a* of the guard driving member 5 and the back handle 4*b*. And, in that state when the push button 3*a* is pushed, the cutter 1 is constituted in such a manner as the arm 3, the guard 6 and the guard driving member 5 are restricted in their stroke by the interference between the block 6*f* of the guard 6 and the tip of the back handle 4*b* and the engagement between the teeth 3*b* and the groove 11 is prevented from being released.

The rotary blade 2 is provided with a penetrated shaft hole 2*a* at the center portion. and is structured in such a manner as a hexagonal column-like blade fitting portion 16*a* formed in the shaft 16 is fitted in said shaft hole 2*a,* the shaft 16 is penetrated through the long hole 6*e* of the guard 6, :a supporting portion 16*b* is fitted in the shaft hole 3*d* of the arm 3, and by screwing a screw member 16*c* formed on the tip end of the shaft 16 through a spring washer 18, it is mounted on the arm 3. Further on a periphery of the dial 5*a* of the guard driving member 5 concave-convex portions are formed at a given spacing, thereby an operation property at the time of turning the dial 5*a* is increased.

The operation of the cutter 1 of the embodiment described above is explained. First, a turning operation of the arm 3 of the cutter is explained.

Figure 4A:
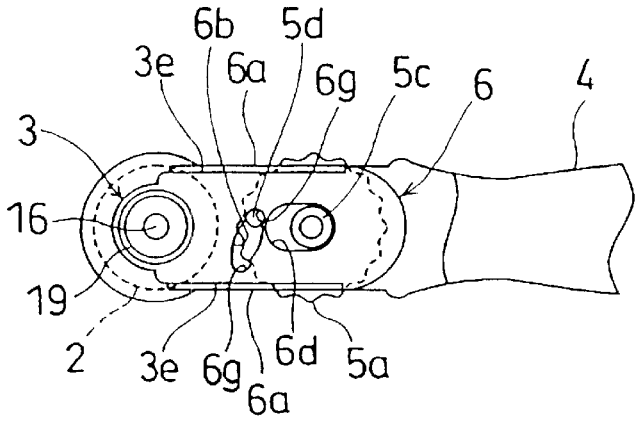
FIG 4A is for explaining a sliding movement of a guard of the cutter of the embodiment of the present invention, showing a state where the guard is moved forward.
Figure 4B:
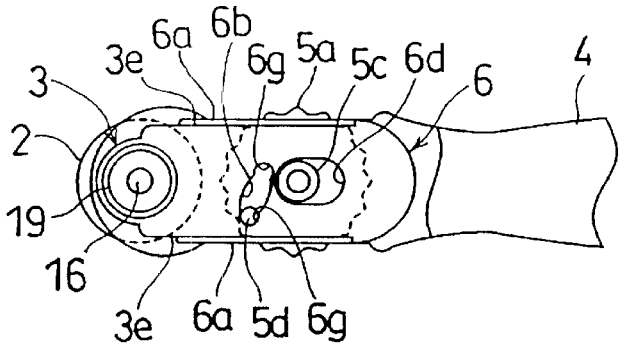
FIG 4B is for explaining a sliding movement of a guard of the cutter of the embodiment of the present invention, showing a state where the guard is moved backward (retracted).
Figure 4C:
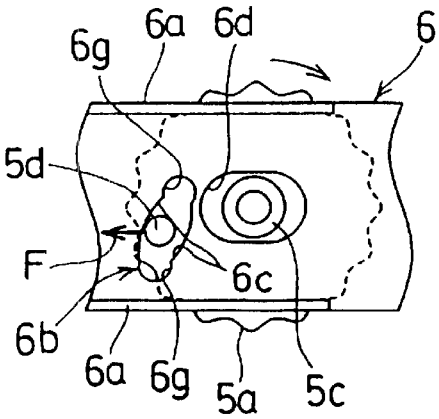
FIG 4C shows partially exploded.
Figure 5:
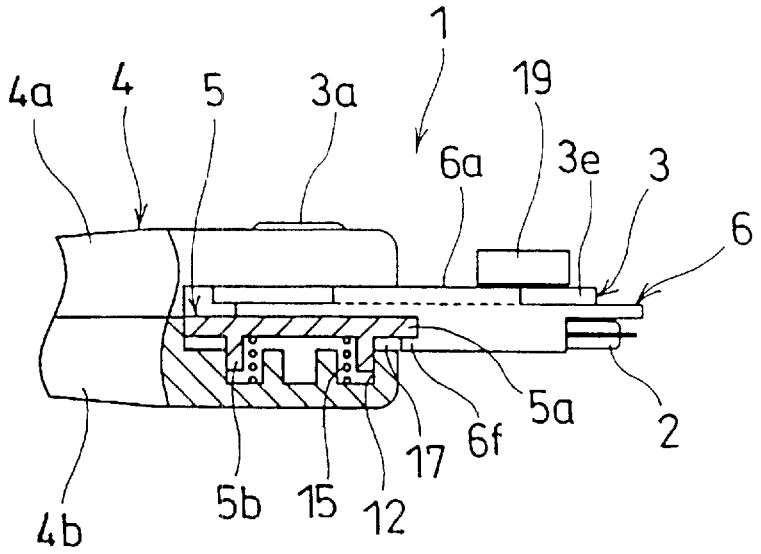
FIG 5 is a side view showing, partially in section, a state wherethe guard is moved forward in the embodiment of the cutter of the present invention.

(1) First, in order to position the arm 3, by progressing the guard 6 as a safety device the interlock mechanism to limit a positioning operation of the arm 3 when the guard 6 is retracted is released. As shown in FIG. 4B, in the state where the guard 6 is retracted, when the dial 5*a* is turned clockwise, the engaging portion 5*d* formed on the upper surface of the dial 5*a* is removed from the hooking portion 6*g* positioned lower of the engaging hole 6*b* in FIG. 4 and turned around the rotary shaft of the dial, so that, a force F (FIG. 4C) is acted on the contact point between the inclined surface 6*c* of the engaging hole 6*b* formed on the guard 6 and the engaging portion 5*d*, and the guard 6 guides the guide portion 6*a* along the side surface 3*e* of the arm 3, so that, the guide 6 is moved to slide toward the progressing direction, and thereby, the cutter of the rotary blade 2 is protected by the guard 6 (see FIG. 4A and FIG. 9), and the interlock mechanism is released. For reference, by the progressing of the guard 6 to a given position, since the engaging portion 5*d* is hooked by the hooking portion 6*g* located upper in FIG. 4, even if the tip end of the guard 6 is pushed, it is not threatened to be pushed toward the retracted direction unintentionally.

Next, when the push button 3*a* is pushed, as shown in FIG. 8, by the coil spring 15 being compressed through the arm 3, the guard 6 and the guard driving member 5 the groove 11 they travel in the space H of FIG. 7 and by disengaging of the teeth 3*b* of the arm 3 and of the front handle 4*a*, while the push button 3*a* is pushed, the arm 3 can be turned against the handle 4. Further, since the teeth 3*b* of the arm 3 and the groove 11 of the front handle 4*a* engage at every 45 degrees, while positioning the arm 3 at the desired angle and by releasing a finger from the push button 3*a*, then the arm 3, the guard 6 and the guard driving member 5 are pushed back by the compressed coil spring 15 and the teeth 3*b* and the groove 11 of the front handle 4*a* are engaged, and the arm 3 can be held at a desired angle. And, after the arm 3 is positioned and held, as shown in FIG. 4 A, when the dial 5*a* is turned anti-clockwise in a state where the guard 6 is progressed, the engaging portion 5*d* formed on the upper surface of the dial 5*a* is removed from the hooking portion 6*g* of the engaging hole 6*b* and turned around the dial rotary shaft and the guard 6 makes the guide portion 6*a* guided along the side surface 3*e* of the arm 3 to move and slide toward the retracted direction, thereby the cutter of the rotary blade 2 is projected (FIG. 4B and FIG. 10) to cut the things to be cut 20 (FIGS. 11~14).

Next, the operation of the interlock mechanism is explained. As mentioned above, in order to turn the arm 3, by pushing the push button 3*a* and making the arm 3, the guard 6 and the guard driving member 5 traveled between the space H of FIG. 7 and the engagement of the teeth 3*b* of the arm 3 with the groove 11 of the front handle 4*a* disengaged. In the interlock mechanism of the embodiment of the present invention when the cutter of the rotary blade 2 is projected while the guard 6 being retracted, as shown in FIG. 6, by interposing the block portion 6f formed on the guard 6 in the gap 17 between the guard driving member 5 and the back handle 4*b*, and by the stroke of the arm 3, the guard 6 and the guard driving member 5, that is, by preventing the teeth 3*b* of the arm and the front handle 4*a* from being released from the engagement with the groove 11, the positioning operation of the arm 3 in the state where the cutter of the rotary blade 2 is projected can be restricted.

Figure 11:
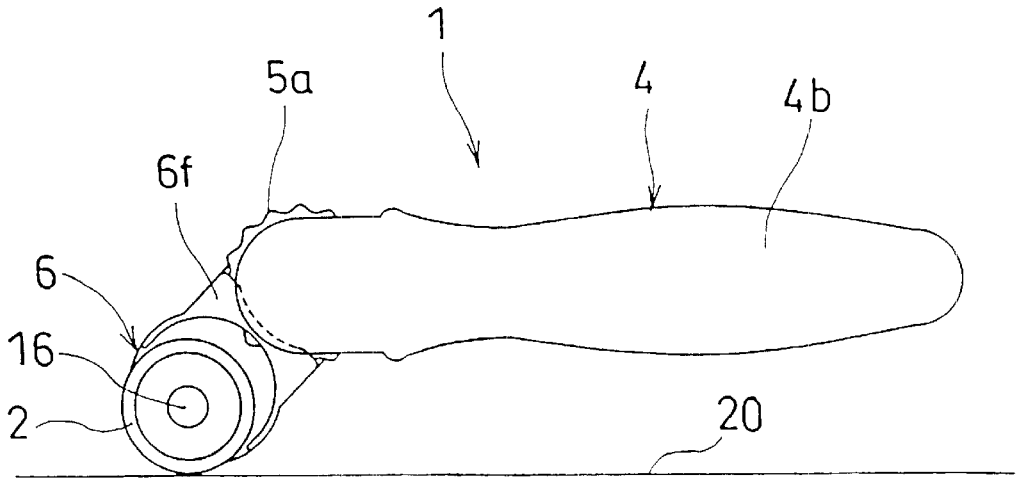
FIG 11 shows a front view of the cutter of the embodiment of the present invention, in particular, for showing a state where an angle of the arm is 45 degrees.
Figure 12:
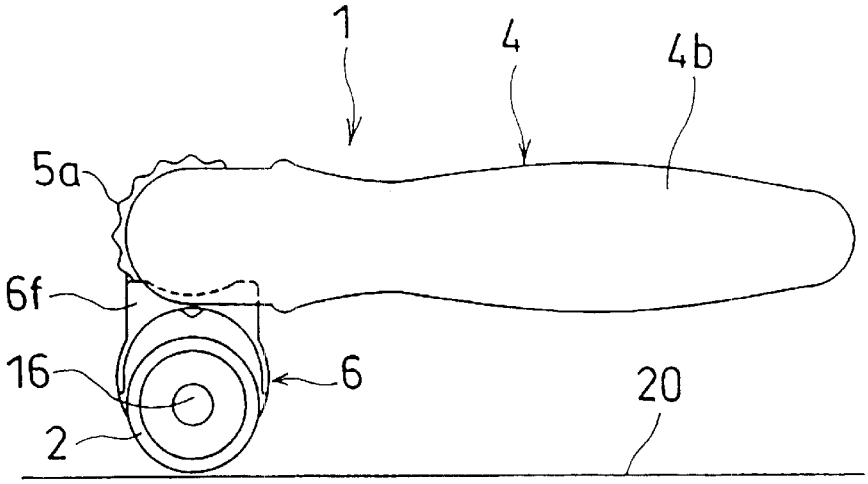
FIG 12 shows a front view of the cutter of the embodiment of the present invention, in particular, for showing a state where an angle of the arm is 90 degrees.
Figure 13:
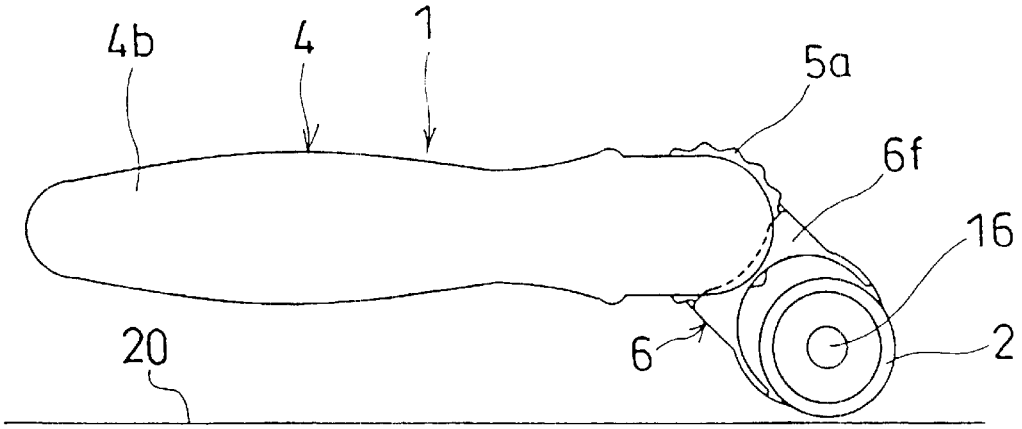
FIG 13 shows a front view of the cutter of the embodiment of the present invention, in particular, for showing a state where an angle of the arm is −45 degrees.
Figure 14:
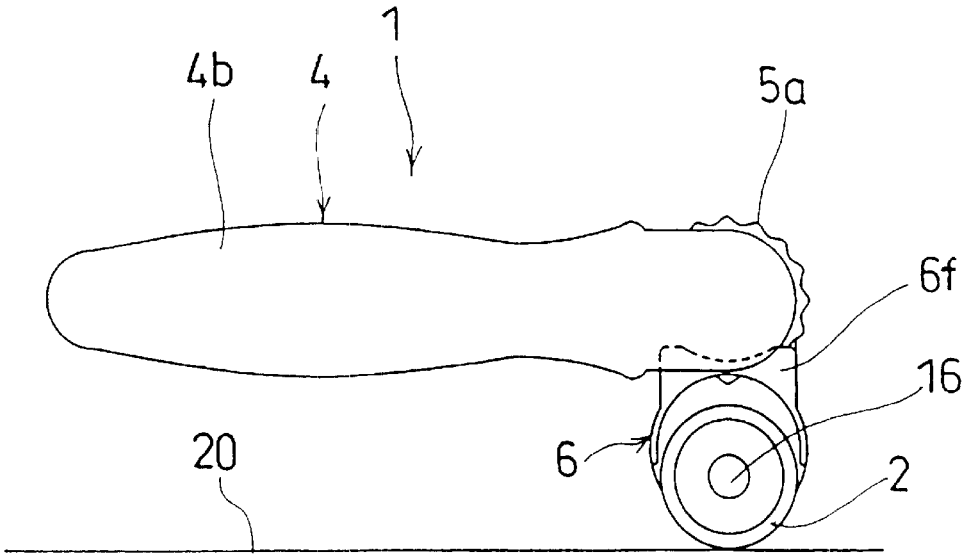
FIG 14 shows a front view of the cutter of the embodiment of the present invention, in particular, for showing a state where an angle of the arm is −90 degrees.
Figure 15:
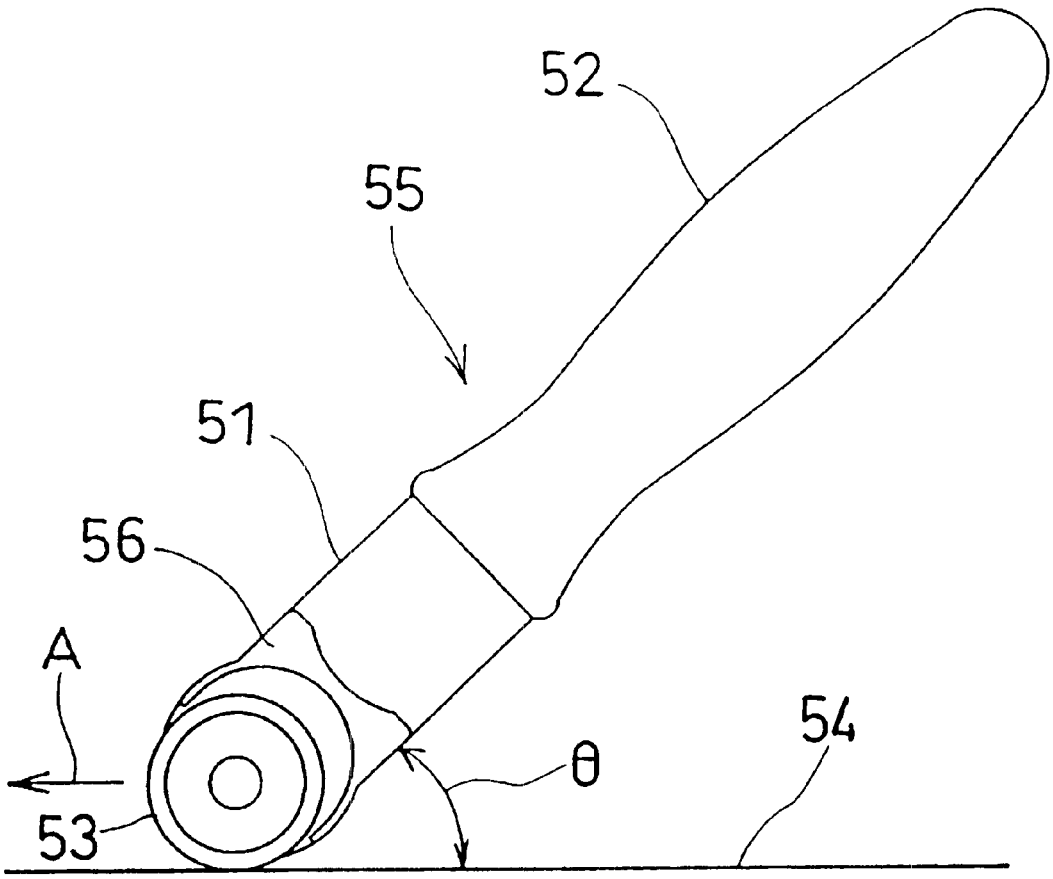
FIG.15 (Prior Art)
FIG 15 is for explaining a conventional cutter.
Figure 16:
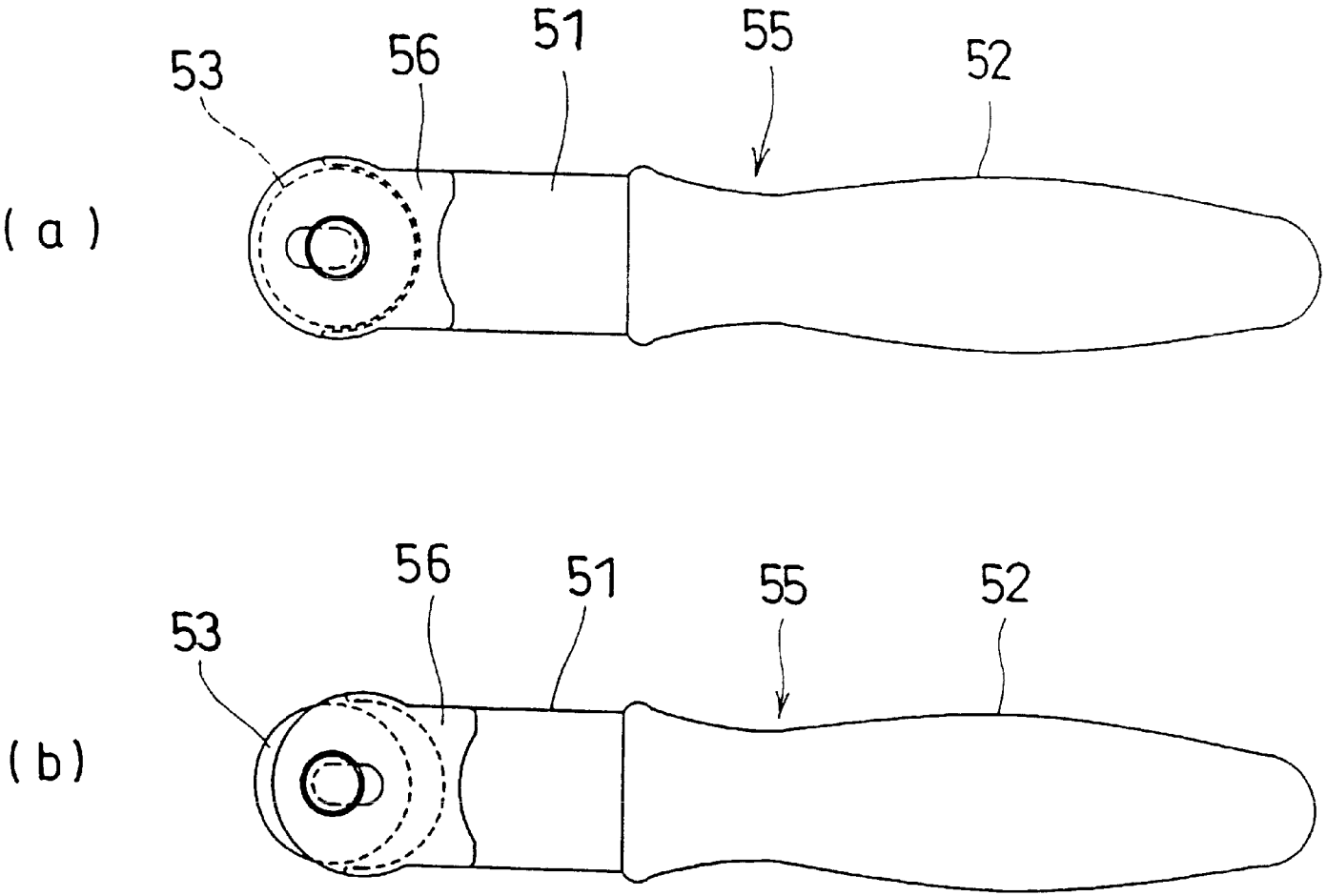
FIG.16 (Prior Art)
FIG 16 is for explaining a conventional cutter, in particular, for showing a conventional with a guard.

Accordingly, in the cutter 1 of the embodiment, by pushing the button 3*a* the engagement of the teeth 3*b* formed on the arm 3 and the groove 11 formed on the front handle 4*a* is released and the arm 3 can be turned, and since the teeth 3*b* and the groove 11 are engaged at every 45 degrees to position and hold the arm 3, any operator can position and hold the arm 3 at 45 degrees shown in FIGS. 1 and 11 and by gripping the handle 4 in parallel with the things to be cut 20, the angle formed between the arm 3 and the things to be cut 20 becomes 45 degrees, so that a straight cutting of the things to be cut 20 can be easily carried out while observing the cutting portion. Further, by positioning and holding the arm 3 at 90 degrees as shown in FIGS. 1 and 12 and gripping the handle 4 in parallel with the things to be cut 20, the angle formed between the arm 3 and the things to be cut 20 becomes 90 degrees, thereby the cutting in various turnings can be easily carried out. Further, where an operator is left-handed, by positioning and holding the arm 3 at −45 degrees as shown in FIG. 1 and gripping the handle 4 in parallel with the things to be cut 20, a linear-like cutting in various turnings can be easily carried out while observing the cutting portion without preventing the eyesight. And, by positioning and holding the arm 3 at −90 degrees as shown in FIG. 1 and gripping the handle 4 in parallel with the things to be cut 20, a cutting in carious turnings can be easily carried out. For reference, in the cutter 1 of this embodiment, although the teeth 3*b* is provided at a regular 45 degrees around the push button 3*a*, for instance the teeth 3*a* may be provided and held at regular 30 degrees, the groove 11 may be provided on the front handle 4*a* in cope with the teeth 3*b* and the arm 3 may be positioned and held at every 30 degrees to the handle 4. And, since there is no obstacle between the guard 6 of the rotary blade 2 and the opposite side thereof, and a cutting face of the things to be cut 20, at the time of being cut straight, by contacting an end of the rotary blade 2 to a scale, a fine finishing of an edge of the things to be cut 20 is expected.

Further, in the cutter 1 of the embodiment, although the positioning operation of the arm 3 in a state where the guard 6 is retracted is restricted, where the cutter of the rotary blade 2 is projected the positioning operation of the arm 3 may be restricted to guarantee safety of the positioning of the arm. In addition to that, since on both sides of the engaging hole 6*b* of the guard 6, the engaging portion 5*d* formed on the guard driving member 5 is hooked with the hooking portion 6*g*, an unintentional movement and sliding are prevented during operating or storing to guarantee a safety of the cutter.

According to the first aspect of the present invention, since the arm provided with the rotary blade can be positioned and held arbitrarily, a straight cutting is easily carried out for instance by positioning the arm at 45 degrees and holding while keeping the handle in parallel with the things to be cut, and by positioning and holding the arm at 90 degrees, cutting in small turns can be easily carried out even where an operator is left-handed, without any difficulty of observing the cutting portion due to any obstacle preventing eyesight, a linear cutting or the cutting in many turns can be easily carried out while keeping the handle in parallel with the things to be cut.

According to the second aspect of the present invention, since the positioning operation of the arm in the state where the guard is retracted is restricted, the positioning operation while the cutter of the rotary blade is projected is prevented to guarantee safety of the positioning operation.

What is claimed is:

1. A rotary blade cutter comprising:

a handle;

an arm, one end of which is pivoted axially on one end of the handle;

a blade provided on the other end of the arm; and a guard that permits the rotation of the arm about the handle when the guard is progressed to guard the blade and that restricts the rotation of the arm about the handle when the guard is retracted.

2. The cutter according to claim 1, wherein the blade is a rotary blade.

3. The cutter according to claim 1, further comprising an interlock, which restricts the rotation of the arm when the guard is retracted.

4. A rotary blade cutter comprising:

a handle;

an arm, one end of which is pivoted axially on one end of the handle;

a blade provided on the other end of the arm; and a guard that permits the rotation of the arm about the handle when the guard is progressed to guard the blade and that restricts the rotation of the arm about the handle when the guard is retracted; and means for positioning and holding the arm against the handle at a desired angle when the guard is progressed to guard the rotary blade.

5. The cutter according to claim 4, wherein the blade is a rotary blade.

6. The cutter according to claim 4, further comprising an interlock, which restricts the rotation of the arm when the guard is retracted.

7. The cutter according to claim 4, wherein the means for positioning and holding the arm against the handle at desired angle comprises:

annular grooves provided on an interior of the handle, and teeth provided on the arm, wherein the teeth engage the grooves provided on the interior of the handle.

8. The cutter according to claim 7, further comprising an interlock, which restricts the rotation of the arm when the guard is retracted.

9. The cutter according to claim 8, wherein the interlock restricts the release of the engagement between the teeth with the annular grooves when the guard is retracted and limits the rotation of the arm.

* * * * *